US011618983B2

(12) United States Patent
Wagner et al.

(10) Patent No.: US 11,618,983 B2
(45) Date of Patent: Apr. 4, 2023

(54) MAKING A NONWOVEN FROM FILAMENTS

(71) Applicants: Tobias Wagner, Cologne (DE); Sebastian Sommer, Troisdorf (DE); Patrick Bohl, Hennef (DE); Andreas Roesner, Bonn (DE); Hans-Georg Geus, Niederkassel (DE)

(72) Inventors: Tobias Wagner, Cologne (DE); Sebastian Sommer, Troisdorf (DE); Patrick Bohl, Hennef (DE); Andreas Roesner, Bonn (DE); Hans-Georg Geus, Niederkassel (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 210 days.

(21) Appl. No.: 16/940,884

(22) Filed: Jul. 28, 2020

(65) Prior Publication Data

US 2021/0032788 A1 Feb. 4, 2021

(30) Foreign Application Priority Data

Jul. 30, 2019 (EP) ..... 19189208

(51) Int. Cl.
*D04H 3/16* (2006.01)
*D01D 5/098* (2006.01)
(Continued)

(52) U.S. Cl.
CPC ..... *D04H 3/16* (2013.01); *D01D 5/088* (2013.01); *D01D 5/0985* (2013.01); *D01G 25/00* (2013.01);
(Continued)

(58) Field of Classification Search
CPC .... D01D 5/088; D01D 5/092; D01D 10/0472; D04H 3/163
See application file for complete search history.

(56) References Cited

U.S. PATENT DOCUMENTS 3,402,492 A 9/1968 Clapham, Jr.
4,583,267 A * 4/1986 Fehrer ..... D01G 15/04 19/302

(Continued)

FOREIGN PATENT DOCUMENTS

EP 1726700 A1 * 11/2006 ..... D04H 3/005
JP 2008144344 A * 6/2008 ..... D04H 3/14

*Primary Examiner* — Emmanuel S Luk
(74) *Attorney, Agent, or Firm* — Andrew Wilford

(57) ABSTRACT

An apparatus for making a nonwoven fabric from thermoplastic plastic filaments has an air permeable deposit conveyor having a horizontal face displaceable in a horizontal travel direction and a spinneret above the conveyor for spinning the filaments and depositing the spun filaments on the deposit conveyor in a deposit area of the conveyor as a nonwoven web for conveyance in the travel direction. An extractor beneath the conveyor draws air or process air through the deposit conveyor in the deposit area in a main extraction area below the deposit conveyor and is delimited by, relative to the travel direction, upstream and downstream suction partitions. One of the partitions has an upper edge set at a predetermined vertical spacing below the conveyor equal to between 10 mm and 250 mm.

18 Claims, 4 Drawing Sheets

(51) Int. Cl.

| | |
|---|---|
| ***D01D 5/088*** | (2006.01) |
| ***D04H 1/435*** | (2012.01) |
| ***D04H 1/4291*** | (2012.01) |
| ***D01G 25/00*** | (2006.01) |

(52) U.S. Cl.
CPC ..... *D04H 1/4291* (2013.01); *D04H 1/435* (2013.01); *D10B 2321/02* (2013.01); *D10B 2331/04* (2013.01)

(56) References Cited

U.S. PATENT DOCUMENTS

| | | | | |
|---|---|---|---|---|
| 4,851,179 | A * | 7/1989 | Reifenhauser | D04H 3/16 264/210.8 |
| 5,766,646 | A * | 6/1998 | Geus | D04H 3/16 264/168 |
| 6,499,982 | B2 * | 12/2002 | Allen | D04H 1/70 425/73 |
| 6,932,590 | B2 | 8/2005 | Geus | |
| 7,004,738 | B2 | 2/2006 | Becker | |
| 8,037,088 | B2 | 10/2011 | Chatterjee et al. | |
| 8,137,088 | B2 * | 3/2012 | Boscolo | D04H 3/03 425/72.2 |
| 2008/0256757 | A1 * | 10/2008 | Mooshammer | D04H 3/04 19/296 |
| 2009/0321982 | A1 * | 12/2009 | Maas | D04H 3/02 425/72.1 |
| 2016/0312384 | A1 * | 10/2016 | Goretzki | D04H 3/02 |
| 2017/0314163 | A1 * | 11/2017 | Sommer | D01D 5/0985 |
| 2018/0282926 | A1 * | 10/2018 | Frey | D01D 5/0985 |
| 2019/0360138 | A1 * | 11/2019 | Nitschke | D04H 1/76 |
| 2021/0032789 | A1 * | 2/2021 | Wagner | D04H 3/147 |

* cited by examiner

MAKING A NONWOVEN FROM FILAMENTS

FIELD OF THE INVENTION

The invention relates to an apparatus for making a nonwoven fabric from filaments, in particular from filaments of thermoplastic plastic. The invention further relates to a corresponding method of making a nonwoven fabric from filaments.

BACKGROUND OF THE INVENTION

Such an apparatus typically comprises at least one spinning apparatus for spinning the filaments and an air-permeable deposit conveyor, in particular a mesh belt, for deposition of the filaments onto the nonwoven web or onto the nonwoven fabric. The filaments forming the nonwoven fabric are continuous filaments that differ due to their almost endless length from staple filaments that have significantly shorter lengths of, for example 10 mm to 60 mm. The nonwoven fabric made according to the invention is preferably composed of such continuous filaments and, particularly preferably, the nonwoven fabric made using the apparatus according to the invention or using the method according to the invention is a spunbond nonwoven fabric.

An apparatus and method for making nonwoven fabrics of the above-described type are known in practice and from the prior art in different variants. For many applications, nonwoven fabrics with a large thickness and a high softness are required. A high thickness of the nonwoven fabric is usually achieved if crimped or crimped filaments are used. In particular, multicomponent filaments or bicomponent filaments with a side-by-side configuration or with an eccentric core-sheath configuration are used for this purpose. Considerable thickness and softness are generally associated with relatively low strength of the nonwoven fabric. This applies both to the tensile strength in the machine direction (MD) and to the abrasion resistance of the nonwoven surface. Increases in strength due to consolidation of the nonwoven material in turn lead to a reduction in the thickness and/or to a reduction in the softness of the nonwovens. In this respect, there is a conflict of goals. Another problem is that the deposited nonwoven webs often do not have the desired homogeneity, particularly with regard to area. Defects in the nonwoven face or nonwoven surface are often found. Such defects are mainly caused by so-called blow-back effects. When the nonwoven web deposited on the deposit conveyor transitions from a more suctioned area of the deposit conveyor to a less suctioned area of the deposit conveyor, filaments or nonwoven components are pulled out of, as it were, from the less suctioned area into the more suctioned area (blow-back effect). This results in disturbing defects or clumps in the nonwoven web or in the nonwoven surface. These are very disadvantageous in terms of optimal product quality.

OBJECT OF THE INVENTION

Accordingly, the object of the invention is to provide an apparatus for making from filaments a nonwoven fabric of high thickness and high softness can be made, but that is nevertheless characterized by a satisfactory strength or abrasion resistance and above all is largely defect-free and in particular free of fibrous clumps. A further object of the invention is to provide a corresponding method of making such a nonwoven.

SUMMARY OF THE INVENTION

An apparatus for making a nonwoven fabric from thermoplastic plastic filaments has an air permeable deposit conveyor having a horizontal face displaceable in a horizontal travel direction and a spinneret above the conveyor for spinning the filaments and depositing the spun filaments on the deposit conveyor in a deposit area of the conveyor as a nonwoven web for conveyance in the travel direction. An extractor beneath the conveyor draws air or process air through the deposit conveyor in the deposit area in a main extraction area below the deposit conveyor and is delimited by, relative to the travel direction, upstream and downstream suction partitions. One of the partitions has an upper edge set at a predetermined vertical spacing below the conveyor equal to between 10 mm and 250 mm.

In other words, to attain these objects, the invention teaches an apparatus for making a nonwoven fabric made of filaments, in particular filaments of thermoplastic plastic, in which at least one spinneret spins the filaments and an air-permeable deposit conveyor, in particular a continuously circulating mesh belt is provided for deposition of the filaments to form the nonwoven web or the nonwoven fabric, wherein at least one extractor is provided for drawing air or process air from below through the deposit conveyor in the deposit area or in the main deposit area of the filaments in a main extraction area and the main extraction area below the deposit conveyor is formed by an inlet area of the deposit conveyor (on the upstream side) and an outlet area of the deposit conveyor (on the downstream side) delimited by upstream and downstream suction partitions, and the upper or conveyor-side edge of at least one of the suction partitions, in particular one suction partition or a part of the corresponding suction partition arranged at the shortest spacing from the deposit conveyor has a vertical spacing A from the deposit conveyor between 10 mm and 250 mm, in particular between 25 mm and 200 mm, preferably between 29 mm and 140 mm and most preferably between 30 mm and 120 mm. "Vertical spacing A" means in particular a spacing A that is measured along a vertical line that runs through the end of the suction partition on the conveyor side and is oriented perpendicularly to the deposit conveyor face.

The geometric parameters and geometric relations given here and below relate in particular to the apparatus in a state without exposure to air, i.e. in particular without extraction of air or process air and without exposure to hot air. However, the apparatus according to the invention is preferably designed in such a way that the geometric parameters and relations are also correct in the air-charged state or are at least largely correct. It is also within the scope of the invention that the suction partitions or the partitions between the extraction areas and the spoiler parts are designed according to fluidic aspects, since the parts also perform flow-directing functions.

According to a preferred embodiment of the invention, the vertical spacing A is 20 mm to 160 mm, preferably 20 mm to 150 mm, preferably 25 mm to 150 mm and in particular 30 mm to 150 mm. According to a particularly preferred embodiment of the invention, at least one suction partition, in particular one suction partition comprises at its upper conveyor-side end a partition section that is angled from the rest of the suction partition and is designed as a spoiler. The end of this spoiler on the conveyor side or an uppermost part of this spoiler with the shortest vertical spacing from the deposit conveyor has the vertical spacing A from the deposit conveyor. In this recommended embodiment of the invention, the spoiler or the angled end section of the suction partition preferably forms an angle α with a vertical V oriented perpendicularly to the deposit conveyor or to the deposit conveyor face F or with the vertical center plane M of the apparatus. This angle α is expediently less than 90° and preferably less than 85°. In this recommended embodiment, the spoiler is proven to be designed as an obliquely angled spoiler with a straight or substantially straight cross section.

According to a further variant of the invention, at least one suction partition, in particular one suction partition comprises at its upper end a spoiler in the form of an L-shaped element with two spoiler parts extending at an angle to one another, and the upper end of this spoiler or a part of this spoiler with the shortest vertical spacing from the deposit conveyor has the vertical spacing A from the deposit conveyor. It is recommended that the spoiler or the L-shaped element has a spoiler part that is aligned transversely, in particular perpendicularly or substantially perpendicularly, to the deposit conveyor face F. Furthermore, it is within the scope of the invention that the spoiler or the L-shaped element has a spoiler part that is oriented parallel or substantially parallel to the deposit conveyor face F. The two spoiler parts are expediently connected to one another directly to form the L-shaped element.

It is within the scope of the invention that the corner or bend point of the spoiler and/or the connection point of the parallel spoiler part of the spoiler has a vertical spacing from the deposit conveyor or the mesh belt of 20 mm to 200 mm, in particular from 30 mm to 190 mm.

It is within the scope of the invention that the maximum extraction of air or process air takes place in the main extraction area delimited by two suction partitions below the main deposit area of the filaments. If air or process air is sucked through the deposit conveyor in further extraction areas of the apparatus according to the invention, in this preferred embodiment the air or process air extracted in the main extraction area has the highest extraction speed $v_H$. It will be described further below that further extraction areas can be connected upstream and/or downstream of the main extraction area. Extraction speeds of air or process air with regard to the extraction by the deposit conveyor or by the mesh belt are measured in the context of the invention, in particular directly above the deposit conveyor or the mesh belt, expediently at a spacing of 0 mm to 5 mm from the deposit conveyor or from the mesh belt.

An extraction area delimited by two suction partitions under the main deposit area of the filaments is basically known from the prior art. The ends of these two suction partitions on the conveyor side are also more or less curved in some apparatuses known from the prior art. However, the ends of these suction partitions on the conveyor side extend as far as the deposit conveyor or as far as the mesh belt and between the conveyor ends of the suction partitions and the deposit conveyor or the mesh belt there is only a very small or no spacing. In this respect, the apparatus according to the invention already differs significantly from these known apparatuses in that, according to the invention, a relatively large vertical spacing A is maintained between the upper end of at least one suction partition and the deposit conveyor or the mesh belt.

A preferred embodiment, which is of particular importance in the context of the invention, is characterized in that only one suction partition of the main extraction area maintains the vertical spacing A from the deposit conveyor and preferably has the spoiler at its end on or at its conveyor side. It is recommended that this suction partition is the suction partition downstream relative to the travel direction of the deposit conveyor. With the help of this embodiment, the object according to the invention can be attained particularly effectively.

According to a recommended embodiment of the invention, the spoiler angled from the body of the suction partition is straight or substantially straight in cross section and the surface of this spoiler is planar or substantially planar. In this respect, this preferred embodiment differs from the configuration of the upper ends of suction partitions known from the prior art that are curved or continuously curved at the conveyor side. It is within the scope of the invention that the angled spoiler is set at an angle α relative to a vertical oriented perpendicularly to the deposit conveyor face F or relative to a vertical center plane M of the apparatus. This angle α is expediently greater than 10°, preferably greater than 15°, preferably greater than 20° and very preferably greater than 25°. According to a recommended embodiment of the invention, the angle α is greater than 30°. Another preferred embodiment of the invention is characterized in that the angle α is greater than 35° and in particular is greater than 40°. It is within the scope of the invention that the angled spoiler is more angled relative to the vertical V extending perpendicular to the deposit conveyor face F or relative to a vertical center plane M of the apparatus than a deposit conveyor-side partition section of the further or opposite suction partition of the main extraction area. It is preferred in the context of the invention that the spoiler according to the invention is more angled by at least 5°, preferably by at least 10° and preferably by at least 15°, than the deposit conveyor-side partition section of the further or opposite suction partition of the main extraction region.

A highly recommended embodiment of the invention is characterized in that the angled spoiler has a greater length L in its vertical projection onto the deposit conveyor face F than the corresponding projection of an angled or bent partition section on the deposit conveyor side of the further or opposite suction partition of the main extraction region. The length L of the projection of the angled spoiler onto the deposit conveyor face F is preferably 30 mm to 200 mm, preferably 35 mm to 180 mm and particularly preferably 40 mm to 150 mm. According to one embodiment of the invention, the length L is 50 mm to 150 mm. An embodiment of the invention is characterized in that the length L is greater than the spacing A or equal to the spacing A from the deposit conveyor. The vertical height h of the angled spoiler, in particular in the projection onto the center plane M of the apparatus, is expediently 5 mm to 300 mm, preferably 10 mm to 150 mm and in particular 15 mm to 100 mm.

It is within the scope of the invention that the spoiler maintains a greater vertical spacing A from the deposit conveyor at its upper end than the upper end of the partition section of the further or opposite suction partition on the deposit conveyor side. The spacing A of the upper end of the spoiler is expediently at least 0.8 times, in particular at least 1.5 times and preferably at least 2 times as large as the corresponding spacing A of the upper end of the deposit conveyor-side partition section of the further or opposite suction partition of the main extraction area. It is within the scope of the invention that the spoiler extends over at least 80%, preferably over at least 85%, preferably over at least 90% and very preferably over at least 95% of the width of the deposit conveyor or the mesh belt transversely or perpendicularly to the machine direction (MD). "Machine direction (MD)" here and below means the travel direction of the deposit conveyor or the travel direction of the deposited nonwoven web.

According to one embodiment of the invention, the spoiler is oriented or angled toward the side of the respective suction partition facing away from the center or from the center plane M of the main extraction region. Here, the spoiler is thus aligned or angled in the travel direction of the deposit conveyor. According to another embodiment of the invention, the spoiler is oriented or angled toward the center or the center plane M of the main extraction area. In this last-mentioned embodiment, the spoiler is thus aligned or angled counter to the travel direction of the deposit conveyor. The spoiler according to the invention can advantageously be used in a two-beam system or in a multibeam system with two or more spinnerets or spinning beams for spinning filaments.

A particularly preferred embodiment of the invention is characterized in that at least two spinnerets or spinning beams are provided for spinning the filaments, and a main extraction area in which air or process air can be sucked through the deposit conveyor or through the mesh belt is associated with each spinneret or spinning beam, each of these main extraction areas being delimited by two suction partitions, at least one suction partition of each main extraction area has a spoiler and a first spoiler of a first main extraction area relative to the travel direction of the deposit conveyor, preferably a spoiler connected to the downstream suction partition of this first main extraction area, being aligned or angled relative to the side of the connected suction partition facing away from the center or from the center plane M of this first main extraction area, and a second spoiler of a second main extraction area downstream of the travel direction of the deposit conveyor, preferably a spoiler connected to the downstream suction partition of this second main extraction area, is aligned or angled toward the center or the center plane M of this second main extraction area.

It is within the scope of the invention that, in each of the at least two main extraction areas of this embodiment, relative to at least one upstream extraction area and/or relative to at least one downstream extraction area, the maximum extraction takes place with the highest extraction speed $v_H$. In the embodiment described above, the spoiler associated with the first spinning beam in the travel direction is aligned or angled in the travel direction of the deposit conveyor, while the spoiler associated with the second spinning beam in the travel direction is aligned or angled counter to the travel direction of the deposit conveyor. It is within the scope of the invention that the filament deposits or nonwoven webs generated by the at least two spinning beams are deposited on the same deposit conveyor or on the same mesh belt. Otherwise, the preferred embodiments and configurations described above with regard to the spoiler preferably apply to the at least two spoilers of the two-bar system or the multibar system.

A recommended embodiment that is of particular importance in the context of the invention is characterized in that the apparatus according to the invention is a spunbond apparatus for making spunbond nonwoven fabrics from continuous filaments. When working with a two-beam system or multibeam system, it is within the scope of the invention that this system has at least two spunbond apparatuses according to the invention or at least two spunbond apparatuses connected in series. An apparatus according to the invention is particularly preferably a spunbond apparatus for making spunbond nonwoven fabrics from crimped continuous filaments. It is within the scope of the invention that multicomponent filaments or bicomponent filaments that expediently have an eccentric core-sheath configuration or a side-by-side configuration, are made with the spunbond apparatus. The spunbond apparatus according to the invention has proven particularly useful for making crimped continuous filaments with an eccentric core-sheath configuration. Preferred embodiments for this are described in more detail below.

It is within the scope of the invention that the apparatus according to the invention or a spunbond apparatus component has at least one cooler downstream of the spinneret and at least one stretcher downstream of the cooler. At least one diffuser is preferably provided downstream of the stretcher. A very particularly preferred embodiment of the invention is characterized in that the subassembly consisting of the cooler and the stretcher is designed as a closed unit and that, apart from the supply of cooling air in the cooler, the entry of further external air supply into this subassembly is blocked. The filaments or continuous filaments leaving the diffuser or the last diffuser in the flow direction of the filaments are deposited on the deposit conveyor or on the mesh belt.

A very proven embodiment of the invention is characterized in that a diffuser directly above the deposit conveyor or above the mesh belt has up and downstream diffuser walls with respective lower diverging diffuser wall sections. The two lower diverging diffuser wall sections of the diffuser are preferably oriented asymmetrically relative to the center plane M of the diffuser. It is recommended that the upstream diffuser wall section relative to the deposit conveyor forms a smaller angle β with the center plane M of the diffuser than the downstream diffuser wall section. Advantageously, the angle β that the upstream diffuser wall section forms with the center plane M is at least 1° smaller than the corresponding angle that the downstream diffuser wall section forms with the center plane M. The asymmetric configuration of the diffuser relative to the center plane M has proven particularly useful with regard to attaining the object according to the invention. It is within the scope of the invention that the ends of the diverging diffuser wall sections on the deposit conveyor side have a different spacing e from the center plane M of the apparatus. The spacing $e_1$ of the upper end of the upstream diffuser wall section is preferably less than the spacing $e_2$ of the upper end of the downstream diffuser wall section from the center plane M of the apparatus. The ratio of the spacings $e_1:e_2$ is expediently 0.6 to 0.95, preferably 0.65 to 0.9 and in particular 0.7 to 0.9. According to one embodiment of the invention, the spacing A from the deposit conveyor is 10% to 200% of the sum of the spacings $e_1$ and $e_2$ ($e_1+e_2$).

A preferred embodiment of the invention is characterized in that the ends of the diverging upstream and downstream diffuser wall sections on the deposit conveyor side have a different vertical spacing from the delivery conveyor or from the mesh belt. The upper end of the upstream diffuser wall section expediently has a smaller spacing from the deposit conveyor or from the mesh belt than the upper end of the downstream diffuser section. The spacing of the upper end of the upstream diffuser wall section is preferably 20% to 60%, in particular 20% to 40% of the spacing of the upper end of the downstream diffuser section from the deposit conveyor. Here, the spacings $e_1$ and $e_2$ are expediently measured horizontally or parallel to the deposit conveyor or to the mesh belt. In a two-bar system or in a multibar system, the above-described embodiment is particularly suitable for the diffuser of the second bar.

A recommended embodiment of the invention is characterized in that the diffuser arranged directly above the deposit conveyor or above the mesh belt has two opposite diffuser walls, and at least two opposite secondary air inlet gaps are provided at the inflow end of the diffuser, each of which are on one of the two opposite diffuser walls. "Inflow end" of the diffuser here means the end of the diffuser into which the drawn filaments or filaments enter. A lower secondary air stream can preferably be introduced through the secondary air inlet gap upstream relative to the travel direction of the deposit conveyor than through the secondary air inlet gap on the downstream side. According to one embodiment of the apparatus according to the invention, the upstream secondary air inlet gap in the machine direction (MD) is narrower than the downstream secondary air inlet gap. It is within the scope of the invention that the width of the upstream secondary air inlet gap and/or the width of the downstream secondary air inlet gap is adjustable. It is recommended that the secondary air stream of the upstream secondary air inlet gap is at least 5%, preferably at least 10% and in particular at least 15% lower than the secondary air stream through the downstream secondary air inlet slot. The embodiment with the different secondary air streams at the upstream secondary air inlet gap and the downstream secondary air inlet gap has proven particularly useful with regard to attaining the object according to the invention.

It is within the scope of the invention that the main extraction area of the spunbond apparatus according to the invention is followed in the travel direction of the deposit conveyor or the mesh belt by a second extraction area in which air or process air is sucked through the deposit conveyor or through the mesh belt. The extraction speed $v_2$ of the process air through the deposit conveyor or through the mesh belt in this second extraction area is preferably lower than the extraction speed $v_H$ in the main extraction area. It is also within the scope of the invention that, in addition to this second extraction area, further extraction areas follow downstream of the main extraction area of a spinning beam in the travel direction of the deposit conveyor. A preferred embodiment of the invention is characterized in that the extraction speed of the air or process air through the deposit conveyor or through the mesh belt decreases from the main extraction area to the further extraction areas in the travel direction, so that the main extraction area has the highest extraction speed $v_H$ and the second extraction area has the second highest extraction speed $v_2$ and the further extraction area following the second extraction area has a lower extraction speed than the extraction speed $v_2$ of the second extraction area.

According to a recommended embodiment of the invention, an upstream extraction area, in which air or process air is drawn through the deposit conveyor or through the mesh belt, is connected upstream of the main extraction area relative to the travel direction of the deposit conveyor. The extraction speed $v_V$ of the process air through the deposit conveyor or through the mesh belt in this upstream extraction area is preferably lower than the extraction speed $v_H$ in the main extraction area. The extraction speed $v_V$ is expediently greater than the extraction speed $v_2$ in the second extraction area. Such an upstream extraction area is provided in particular if the following main extraction area is associated with a spinning beam that follows at least one first spinning beam in a two-bar system or in a multibeam system. In this last-mentioned embodiment with an upstream extraction area, a spoiler connected to the downstream suction partition is expediently angled toward the center or the center plane M of the main extraction area. According to another embodiment, this spoiler can also be aligned or angled in the travel direction of the deposit conveyor. In the case of a two-bar system or multibar system, it is recommended that a spoiler connected to the downstream suction partition of the first main extraction area of the first spinning beam should be aligned or angled toward the side of the connected suction partition facing away from the center of this first main extraction area and thus in the travel direction of the deposit conveyor.

A particularly preferred embodiment of the invention is characterized in that at least one spoiler of at least one suction partition of the main extraction area and in particular one spoiler of the downstream suction partition is designed and/or arranged and/or aligned wherein there is a continuous uniform transition from the extraction speed $v_H$ of the main extraction area to the extraction speed $v_2$ of the second extraction area and/or there is a continuous uniform transition from the extraction speed $v_V$ of the upstream extraction area to the extraction speed $v_H$ of the main extraction area.

It is particularly preferred that the extraction speed decreases uniformly and continuously from the extraction speed $v_H$ in the main extraction area to the extraction speed $v_2$ in the downstream second extraction area over a transition range of at least 14 cm, in particular of at least 16 cm and preferably of at least 18 cm in length. Furthermore, it is preferred that in the case of the upstream extraction area the extraction speed increases uniformly and continuously from the extraction speed $v_V$ in the upstream extraction area to the extraction speed $v_H$ in the main extraction area over a transition range of at least 10 cm, in particular at least 16 cm and preferably at least 18 cm in length. In both cases the transition range is expediently a maximum of 40 cm, in particular a maximum of 35 cm and preferably a maximum of 30 cm long. In apparatuses known from the prior art the decrease in the extraction speed or the increase in the extraction speed described above takes place more or less abruptly. In contrast, according to the invention, a transition range of at least 10 cm is created for the continuous transition of the extraction speeds.

A particularly recommended embodiment of the invention is characterized in that at least one preconsolidater, in particular one preconsolidater for preconsolidating the nonwoven fabric is provided above the second extraction area, downstream of the main extraction area. This preconsolidater is expediently a hot-air preconsolidation apparatus and preferably a hot-air knife. In principle, a hot-air oven could also be used as a hot-air preconsolidater. In principle, preconsolidation is also possible with compacting rollers and/or with a calender. A proven embodiment of the invention is characterized in that the spacing B between the center plane M of the apparatus or of the diffuser and the preconsolidater is 100 mm to 1000 mm, in particular 110 mm to 600 mm and preferably 120 mm to 550 mm. The spacing B is measured in particular between the center plane M and the first component or structural component of the preconsolidater that follows in the travel direction.

To attain the object according to the invention, the invention further teaches a method of making a nonwoven fabric made of filaments, in particular of filaments of thermoplastic plastic, the filaments are spun and deposited on an air-permeable deposit conveyor, in particular on an air-permeable mesh belt to the nonwoven web or nonwoven fabric, in the deposit area for the filaments air or process air is sucked in from below through the deposit conveyor or through the mesh belt in a main extraction area, and the main extraction area is delimited by two suction partitions arranged one behind the other in the machine direction (MD), therein an extraction area upstream of the main extraction area or the upstream suction partition relative to the travel direction of the deposit conveyor is provided and/or a second extraction area is provided downstream of the main extraction area or the downstream suction partition, in the upstream extraction area and/or in the downstream second extraction area air is sucked through the deposit conveyor or through the mesh belt with a lower extraction speed than in the main extraction area, and at least one conveyor-side partition section of a suction partition is aligned or angled, and in particular an angled spoiler is arranged or aligned at the upper end of a suction partition, each such that the extraction speed of the air extracted through the deposit conveyor increases continuously and uniformly from the upstream extraction area to the main extraction area and/or that the extraction speed of the air extracted through the deposit conveyor or through the mesh belt decreases continuously and uniformly from the main extraction area to the downstream second extraction area.

According to the recommended embodiment of the invention, the extraction speed $v_H$ in the main extraction area is 1.2 to 5 times, preferably 1.5 to 4 times, preferably 2 to 4 times and very preferably 2.5 to 3.5 times greater than the extraction speed $v_V$ in the upstream extraction area and/or the extraction speed $v_2$ in the downstream second extraction area. The extraction speed expediently decreases continuously and uniformly from the extraction speed $v_H$ in the main extraction area to the extraction speed $v_2$ in the downstream second extraction area in a transition range of at least 10 cm, in particular at least 14 cm, preferably at least 16 cm and preferably at least 18 cm in length. The length of the transition range is preferably a maximum of 40 cm and in particular a maximum of 30 cm. In this respect, there is a difference from the methods known from the prior art, in which the extraction speed mentioned decreases abruptly from the extraction speed $v_H$ in the main extraction area to a lower extraction speed $v_2$.

In the case of an extraction area upstream of the main extraction area, the extraction speed increases continuously and uniformly from the extraction speed $v_V$ in the upstream extraction area to the extraction speed $v_H$ in the main extraction area in a transition range of at least 10 cm, in particular at least 14 cm, preferably at least 16 cm and preferably at least 18 cm in length. The transition range is expediently a maximum of 40 cm and preferably a maximum of 30 cm.

It is within the scope of the invention that in the method according to the invention a spunbond nonwoven fabric is made from continuous filaments and in particular from crimped continuous filaments. The continuous filaments are expediently bicomponent filaments or multicomponent filaments, specifically preferably bicomponent filaments or multicomponent filaments with an eccentric core-sheath configuration. It is much preferred to use bicomponent filaments or multicomponent filaments with an eccentric core-sheath configuration in which the sheath in the filament cross section has a steady thickness d or a substantially steady thickness d over at least 20%, in particular at least 25%, preferably at least 30%, preferably at least 35% and very preferably at least 40% of the filament circumference. It is recommended that the core of the filaments preferably takes up more than 50%, in particular more than 55%, preferably more than 60%, preferably more than 65% and very preferably more than 70% of the area of the filament cross section of the filaments. Expediently, the core of the filaments is designed in the form of a segment of a circle as seen in the filament cross section and relative to its circumference it has a circular arcuate or a substantially circular arcuate surface region and a straight or substantially straight surface region. The circular arcuate surface region of the core preferably occupies more than 50%, in particular over 55%, preferably over 60% and very preferably over 65% of the circumference of the core. It is within the scope of the invention that the sheath of the filaments, as seen in the filament cross-section, is formed in the shape of a segment of a circle outside the sheath region with the steady thickness d, wherein this segment of the circle preferably has a circular arcuate or substantially circular arcuate surface region relative to its circumference and has a straight or substantially straight surface region. According to a particularly preferred embodiment of the invention, the sheath of the filaments, viewed in the filament cross section, has a steady thickness d or a substantially steady thickness d over 45%, in particular over 50%, preferably over 55% and preferably over 60% of the filament circumference. It is recommended that the thickness of the sheath in the region of its steady or substantially steady thickness d is less than 10%, in particular less than 8% and preferably less than 3% of the filament diameter D or of the largest filament diameter D. The thickness of the sheath in the region of its steady or substantially steady thickness d is preferably 0.05 μm to 5 μm, in particular 0.1 μm to 4 μm, preferably 0.1 μm to 3 μm and preferably 0.1 μm to 2 μm. A much preferred embodiment of the invention is characterized in that, relative to the filament cross section, the spacing a of the centroid of the core from the center of the sheath is 5% to 45%, in particular 6% to 40% and preferably 6% to 36% of the filament diameter D or of the largest filament diameter D.

Filaments or continuous filaments that consist or substantially consist of at least one polyolefin have proven particularly useful in the method according to the invention. The filaments or continuous filaments expediently consist of polyethylene and/or polypropylene. If filaments of core-sheath configuration or having an eccentric core-sheath configuration are used within the scope of the invention, the core and/or the sheath of the filaments or filaments advantageously consists of at least one polyolefin or substantially of at least one polyolefin. It is particularly preferred that both the core and the sheath of the filaments consist or substantially consist of at least one polyolefin. In particular, the sheath consists of polyethylene or substantially of polyethylene and the core preferably consists of polypropylene or substantially of polypropylene. In principle, it is also within the scope of the invention that the core and/or the sheath of the filaments consists or substantially consists of at least one polyester and/or copolyester. A variant of the invention is characterized in that the core of the filaments consists or substantially consists of a polyester and/or a copolyester and that the sheath of the filaments consists of a polyolefin. Another embodiment variant is characterized in that the core of the filaments consists or substantially consists of a polyester and in that the sheath consists or substantially consists of a polyester and/or copolyester with a lower melting point than the core component.

A recommended embodiment of the invention is characterized in that the components of the filaments or of the core and/or of the sheath of the filaments with an eccentric core-sheath configuration consists/consist or substantially consists/consist of at least one polymer from the group "polyolefin, polyolefin copolymer, in particular polyethylene, polypropylene, PE copolymer, PP copolymer; polyester, polyester copolymer, in particular polyethylene terephthalate (PET), PET copolymer, polybutylene terephthalate (PBT), PBT copolymer, polylactide (PLA), PLA copolymer." It is also possible for the components or the core and/or the sheath to consist or substantially to consist of mixtures or blends of these polymers.

It is within the scope of the invention that in the filaments used according to the invention with an eccentric core-sheath configuration the plastic of the sheath has a lower melting point than the plastic of the core. In the context of the method according to the invention, filaments or filaments with a linear density between 1 den and 12 den and very preferably between 1.0 den and 2.5 den are expediently used. A much-recommended embodiment of the invention is characterized in that filaments or filaments with a linear density of 1.7 den to 2.3 den, preferably from 1.8 den to 2.2 den, are used.

It is also within the scope of the invention that the nonwoven web deposited in the main deposit area and above the main extraction area is preconsolidated after the main deposit area with a preconsolidater, preferably preconsolidated by hot air. The preconsolidater or hot-air preconsolidater is expediently located above the second extraction area, in which process air is preferably sucked through the deposit conveyor with the extraction speed $v_2$. According to one embodiment of the invention, after the first preconsolidater the nonwoven web is guided with the deposit conveyor to a second preconsolidater that is also expediently designed as a hot-air preconsolidater. It is within the scope of the invention that process hot air is sucked through the deposit conveyor at or under this second preconsolidater, with an extraction speed $v_X$ that is less than the extraction speed $v_H$ of the main extraction area and that is also less than the extraction speed $v_2$ of the second extraction area. It is within the scope of the invention that both preconsolidations or both preconsolidations with hot air are carried out over the same deposit conveyor. According to a recommended embodiment, the first preconsolidater is designed as a hot-air knife and the second preconsolidater is designed as a hot-air oven. In principle, other combinations of preconsolidaters or hot-air preconsolidaters can also be used.

The invention is based on the knowledge that nonwoven fabrics and in particular spunbond nonwoven fabrics that are largely defect-free and have a homogeneous nonwoven face or nonwoven surface can be made using the apparatus according to the invention and using the method according to the invention. The invention is also based on the knowledge that, above all, harmful backflow effects (blow-back effects) in the transition area between the main deposit area and the subsequent areas of the deposit conveyor can be virtually eliminated and the associated defects, in particular clumps of filaments, can be largely avoided. In addition, the invention is based on the finding that the apparatus and the method according to the invention are particularly suitable for nonwoven fabrics made from crimped filaments or filaments. Nonwoven fabrics with a high thickness and high softness can be made here without any problems and above all without defects and without disruptive filament clumps. In this context, continuous filaments with an eccentric core-sheath configuration, and above all the preferred filaments described above with an eccentric core-sheath configuration, have proven particularly effective. The nonwoven fabrics made according to the invention can be easily and selectively consolidated without having to accept undesirable losses in thickness or softness. It is possible to achieve sufficient strength (in the MD direction) of the nonwoven fabrics, on the one hand, and sufficient abrasion resistance, on the other hand. At the same time, a desired thickness and softness can be maintained without problems, and above all without disruptive defects in the nonwoven face. In this respect, an optimal combination of thickness, softness, strength and freedom from defects can be achieved and, above all, the desired properties can be set simply and reliably by appropriate selection of the parameters. The nonwoven fabrics made according to the invention meet all requirements for an optimal high-loft nonwoven. In addition, these advantageous properties can be achieved with relatively little effort.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
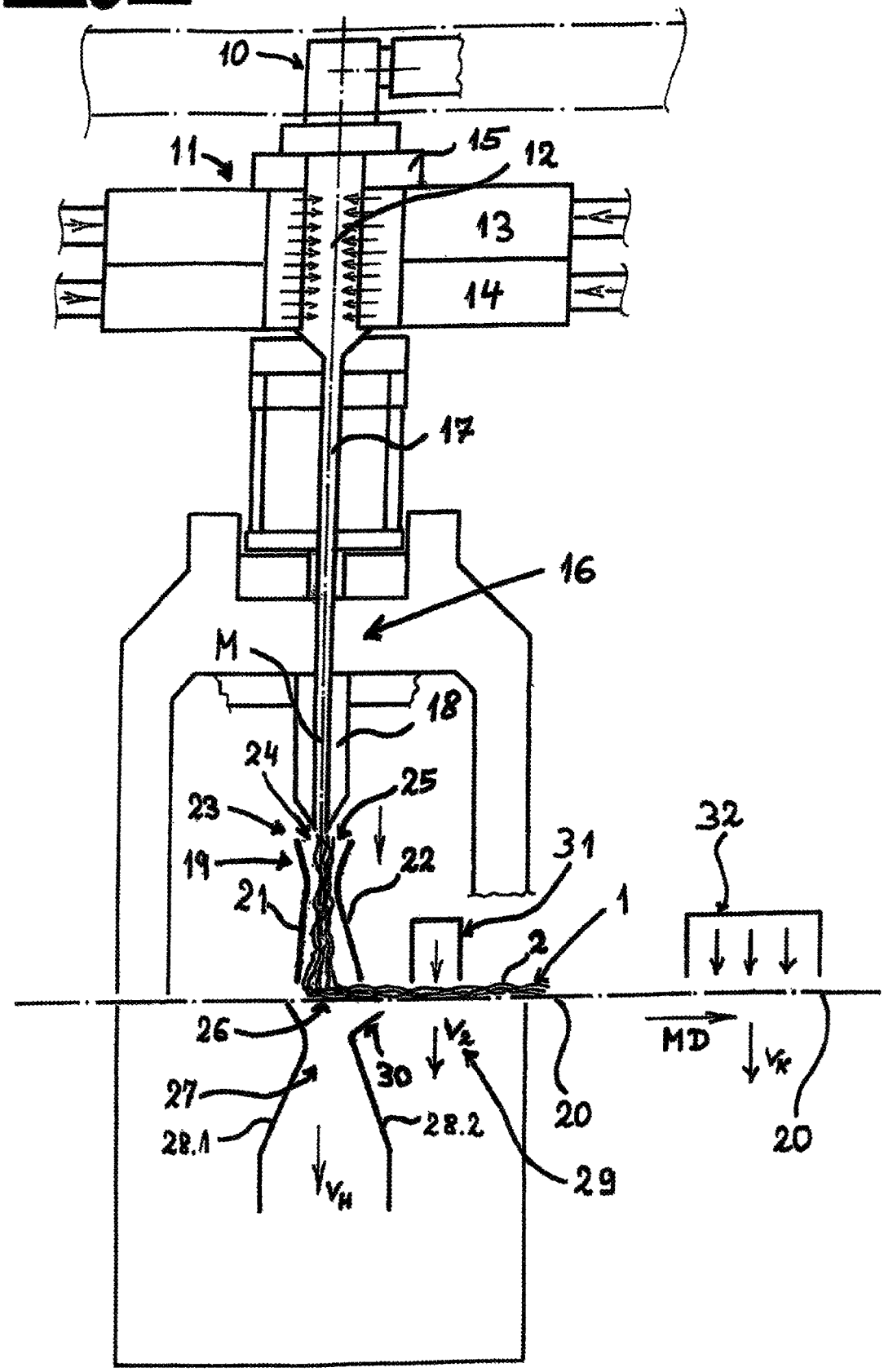
FIG. 1 is a vertical section through an apparatus according to the invention for making a nonwoven fabric.

FIG. 1 shows an apparatus according to the invention for making a nonwoven fabric 1 from filaments of thermoplastic material, where preferably and here the filaments are continuous filaments 2, and specifically as recommended and according to this embodiment the filaments are bicomponent filaments with an eccentric core-sheath configuration. Continuous filaments 2 with an eccentric core-sheath configuration that are particularly preferred in the context of the invention are described in more detail below. As recommended and according to this embodiment, the apparatus according to the invention is designed as a spunbond apparatus for making spunbond nonwoven fabric.

FIG. 1 shows a spinneret 10 for spinning the continuous filaments 2. Preferably and according to this embodiment, the spun endless filaments 2 are introduced into a cooler 11 with a cooling chamber 12. Expediently and according to this embodiment, air supply compartments 13 and 14 are one above the other on two opposite sides of the cooling chamber 12. Air at different temperatures is expediently introduced into the cooling chamber 12 from these air supply compartments 13 and 14 arranged one above the other. According to the recommended embodiment and here, a monomer extractor 15 is between the spinneret 10 and the cooler 11. With this monomer extractor 15, disruptive gases occurring during the spinning process can be removed from the apparatus. These gases can be, for example monomers, oligomers or decomposition products and the like.

In the filament flow direction, a stretcher 16 for drawing the continuous filaments 2 is provided downstream of the cooler 11. Preferably and according to this embodiment, the stretcher 16 has an intermediate passage 17 that connects the cooler 11 to a shaft 18 of the stretcher 16. According to a particularly preferred embodiment and here, the subassembly consisting of the cooler 11 and the stretcher 16 or the subassembly consisting of the cooler 11, the intermediate passage 17 and the shaft 18 is designed as a closed unit and, apart from the supply of cooling air in the cooler 11, further air entry from the outside into this subassembly is blocked.

As recommended and according to this embodiment, a diffuser 19 through which the continuous filaments 2 pass adjoins the stretcher 16 in the filament flow direction. Preferably and according to this embodiment, after passing through the diffuser 19, the continuous filaments are deposited on a deposit conveyor designed as a mesh belt 20. Preferably and according to this embodiment, the mesh belt 20 is designed as an endlessly circulating mesh belt 20. It is within the scope of the invention that the mesh belt 20 is air-pervious, so that process air can be extracted from below through the mesh belt 20.

According to the recommended embodiment and here, the diffuser 19 directly above the depositing belt 20 has upstream and downstream diffuser walls forming respective upstream and downstream lower diverging diffuser wall sections 21 and 22 that, preferably and according to this embodiment flank a center plane M of the diffuser 19. Expediently and according to this embodiment, the upstream diffuser wall section 21 at its lower edge has a smaller spacing $e_1$ from the center plane M of the diffuser 19 or of the apparatus than the spacing $e_2$ of the downstream diffuser wall section 22 or the lower edge of the downstream diffuser section 22. As recommended and according to this embodiment, the upstream diffuser wall section 21 forms a smaller angle β with the center plane M of the diffuser 19 or of the apparatus than the downstream diffuser wall section 22.

According to a recommended embodiment of the invention, two opposite secondary air inlet gaps 24 and 25, each of which is on a respective one of the two opposite diffuser walls, are provided at the inflow end 23 of the diffuser 19. A smaller secondary air stream can preferably be introduced through the secondary air inlet gap 24 upstream relative to the travel direction of the mesh belt 20 than through the downstream secondary air inlet gap 25.

Preferably and according to this embodiment at least one extractor is provided that can draw air or process air through the mesh belt 20 in the deposit area or in the main deposit area 26 of the filaments 2 in a main extraction area 27. The main extraction area 27 is delimited below the mesh belt 20 in an inlet area of the mesh belt 20 and in an outlet area of the mesh belt 20 by a upstream and downstream suction partitions 28.1 and 28.2.

It is within the scope of the invention that at least one of the suction partitions 28.1 and 28.2 has at its upper end turned toward the conveyor a partition section designed as a spoiler 30. Here according to FIGS. 1 and 2, the downstream suction partition 28.2 has at upper end a partition section angled from the rest of the suction partition 28.2 and designed as a spoiler 30. Here shown in FIGS. 1 and 2, the spoiler 30 is, as it were, an integral part of the downstream suction partition 28.2 and is merely designed as an angled section of this partition 28.2. Preferably and according to this embodiment, the vertical spacing A of the upper end of the spoiler 30 from the mesh belt 20 is between 10 mm and 250 mm, in a preferred embodiment between 18 mm and 120 mm. Preferably and here according to FIGS. 1 and 2, the spoiler 30 is angled on the side of the respective suction partition 28.2 facing away from the center of the main extraction region 27.

Figure 3:
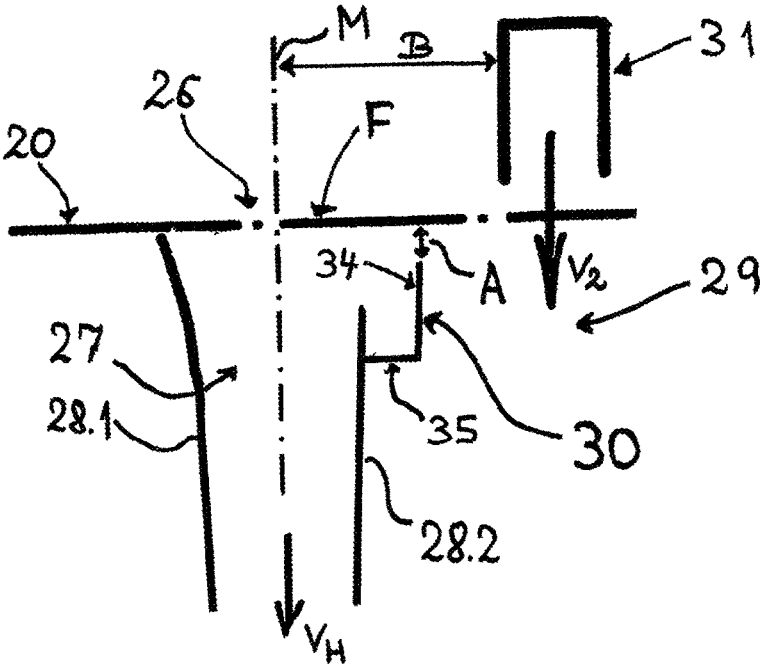
FIG. 3 shows the structure according to FIG. 2 in an alternative embodiment.

FIG. 3 shows a further embodiment of a spoiler 30. The spoiler 30 is connected here as a separate L-shaped element to the downstream suction partition 28.2. Preferably and according to this embodiment, the L-shaped element is composed of only two spoiler parts 34, 35 that are angled relative to one another. Expediently and according to this embodiment, the two spoiler parts 34, 35 are oriented at a right angle to one another. Preferably, one spoiler part 34 of the spoiler 30 is perpendicular to the deposit conveyor face F of the mesh belt 20 and the other spoiler part 35 is oriented parallel to the deposit conveyor face F. Here, the end of the spoiler 30 on the conveyor side also has the spacing A according to the invention from the deposit conveyor or the mesh belt 20.

Preferably and here according to FIG. 1, a second extraction area 29 in which air or process air is sucked through the mesh belt 20 is connected downstream of the main extraction area 27 in the travel direction of the mesh belt 20. Preferably and according to this embodiment, the extraction speed $v_2$ of the process air through the mesh belt 20 in the second extraction area 29 is lower than the extraction speed $v_H$ in the main extraction area 27.

It is within the scope of the invention that downstream of the deposit area 26 or downstream of the main extraction area 27 in the travel direction of the nonwoven web there is at least one thermal preconsolidater for thermal preconsolidation of the nonwoven web. Furthermore, it is within the scope of the invention that this thermal preconsolidater is on or above the second extraction region 29. According to a particularly preferred embodiment, the thermal preconsolidater works with hot air, and particularly preferably this thermal preconsolidater connected downstream of the main extraction region 27 is a hot-air knife 31. In principle, however, another preconsolidater or hot-air preconsolidater could also be used. Bonds between the filaments 2 of the nonwoven web can be formed in a simple manner with the thermal preconsolidater or hot-air preconsolidater. The spacing B (FIGS. 2 and 3) between the center plane M of the diffuser 19 or of the apparatus and the first hot-air preconsolidater, in particular in the form of the hot-air knife, is expediently 31-120 mm to 550 mm.

According to one embodiment of the invention, at least two thermal preconsolidaters are provided for preconsolidating the nonwoven web. FIG. 1 shows a preferred embodiment here. The first thermal preconsolidater in the travel direction of the nonwoven web is a hot-air knife 31 and a second thermal preconsolidater in the form of a hot-air oven 32 is preferably connected downstream of this hot-air knife 31 in the travel direction of the mesh belt 20. It is within the scope of the invention that air is also sucked through the mesh belt 20 at the hot-air oven 32. Furthermore, it is within the scope of the invention that the extraction speed of the air sucked through the mesh belt 20 decreases from the main extraction area 27 to the further extraction areas in the travel direction of the mesh belt 20.

The spoiler 30 according to the invention ensures a continuous and more or less smooth transition of the extraction speeds from the main extraction area 27 to the second extraction area 29. In the embodiment according to FIGS. 1 to 3, the spoiler 30 is aligned or angled to the side of the respective suction partition 28.2 facing away from the center of the main extraction region 27 or to the side facing away from the center plane M.

Figure 2:
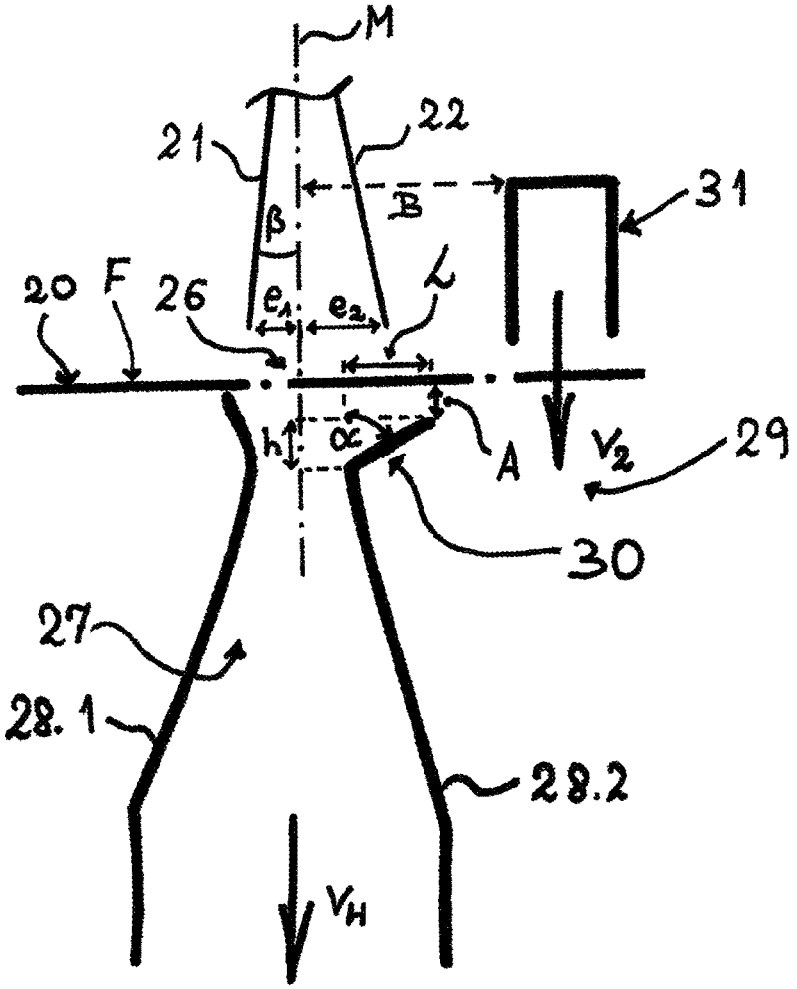
FIG. 2 is an enlarged detail from FIG. 1 at the deposit conveyor.

In the preferred embodiment of the spoiler 30 shown in FIG. 2, the spoiler 30 is more strongly angled relative to a vertical V extending perpendicular to the deposit conveyor face F than a dividing wall section of the upstream partition 28.1 facing the mesh belt 20. FIG. 2 also shows that, according to a preferred embodiment, the spoiler 30 has a greater length L in its projection onto the deposit conveyor face F than the corresponding projection of an angled or bent partition section of the further upstream partition 28.1 facing the mesh belt 20. Furthermore, FIG. 2 shows that, according to a particularly preferred embodiment, the spoiler 30 has a greater vertical spacing A from the mesh belt 20 relative to its end on the mesh belt side than the end of the partition section of the upstream partition 28.1 facing the mesh belt 20. A vertical height h of the spoiler 30 (projection onto the center plane M) is preferably 5 mm to 110 mm, in particular 15 mm to 100 mm.

As mentioned above, a spoiler 30 according to the invention ensures a very uniform and continuous transition of the extraction speeds from the main extraction area 27 to the area following it in the travel direction of the mesh belt 20 and in particular to the second extraction area 29. Due to the orientation of the spoiler 30 a gradual, continuous and steady decrease in the extraction speed can be achieved. This will be described below with reference to FIG. 4. The gradual continuous decrease in the extraction speed makes it possible to avoid defects that can be caused by abrupt changes in extraction speed in the nonwoven web or in the spunbond nonwoven fabric 1 according to the invention. Above all, the so-called blow-back effects in the transition area between the main extraction area 27 and the second extraction area 29, which lead to disadvantageous inhomogeneities in the nonwoven web in apparatuses known from the prior art and in particular to disruptive filament agglomerates, can be avoided.

Figure 4:
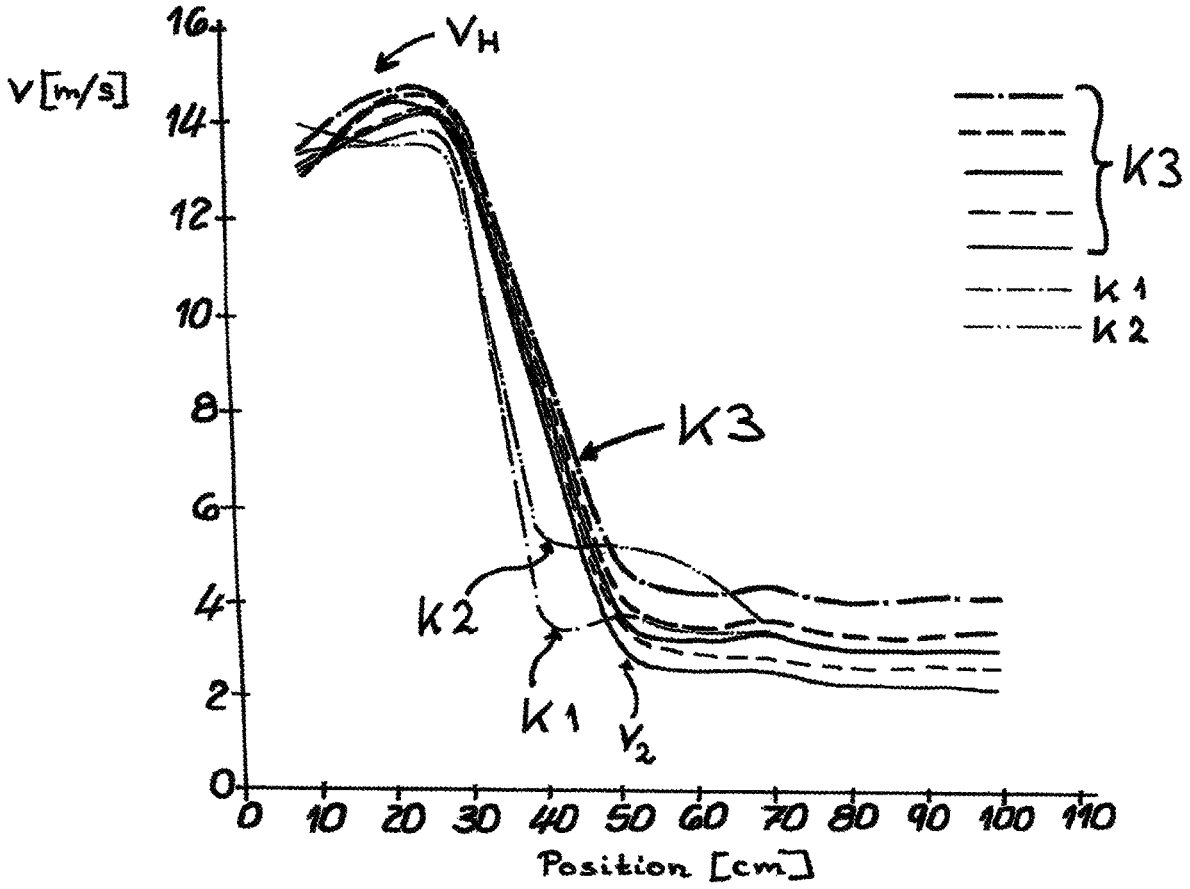
FIG. 4 is a graph showing the dependence of the extraction speed on the position in the transition area between the main extraction area and the second extraction area.

FIG. 4 shows schematically the extraction speed v through the mesh belt 20 at various positions along the mesh belt 20 in the transition area between the main extraction area 27 and the second extraction area 29. For the profiles shown, the extraction speed was measured in a 10 cm grid with an impeller anemometer with a diameter of 80 mm, spaced directly above the mesh belt 20 by 0 mm to 5 mm. The maximum on the left corresponds to the high extraction speed $v_H$ in the main extraction area 27 and the more or less horizontal curves on the right show the extraction speed $v_2$ in the second extraction area 29. The drop in the curves between the maximum and the horizontal outlet corresponds to the transition of the extraction speeds v between the main extraction area 27 and the second extraction area 29. The curves K1 and K2 correspond to the drop in the extraction speed in conventional spunbond apparatuses without a spoiler 30 according to the invention. The curves K3 illustrate the drop in the extraction speed for a spunbond apparatus according to the invention with a spoiler 30, specifically at different extraction speeds $v_2$. An angled spoiler 30 according to FIG. 2 was used here. It can be seen that the extraction speeds for the conventional spunbond apparatuses (curves K1 and K2) drop very abruptly in the transition area between the main extraction area 27 and the second extraction area 29. In contrast, in a spunbond apparatus according to the invention with a spoiler 30 the extraction speed drops less abruptly and rather gradually and continuously here in a transition area or over a mesh belt section of approximately 20 cm. In comparison to the conventional spunbond apparatuses without a spoiler 30, there is therefore a much smoother continuous decrease in the extraction speeds. The invention is based on the discovery that this is associated with the considerable advantage that disadvantageous blow-back effects in the transition area between the main extraction area 27 and the second extraction area 29 can be largely avoided. Therefore, compared to the conventional spunbond apparatuses, nonwoven webs can be made according to the invention that are made much more homogeneous over their face or surface and in particular have no disruptive filament agglomerates. In this respect, a spunbond apparatus according to the invention with a spoiler 30 is characterized by considerable advantages.

Figure 5:
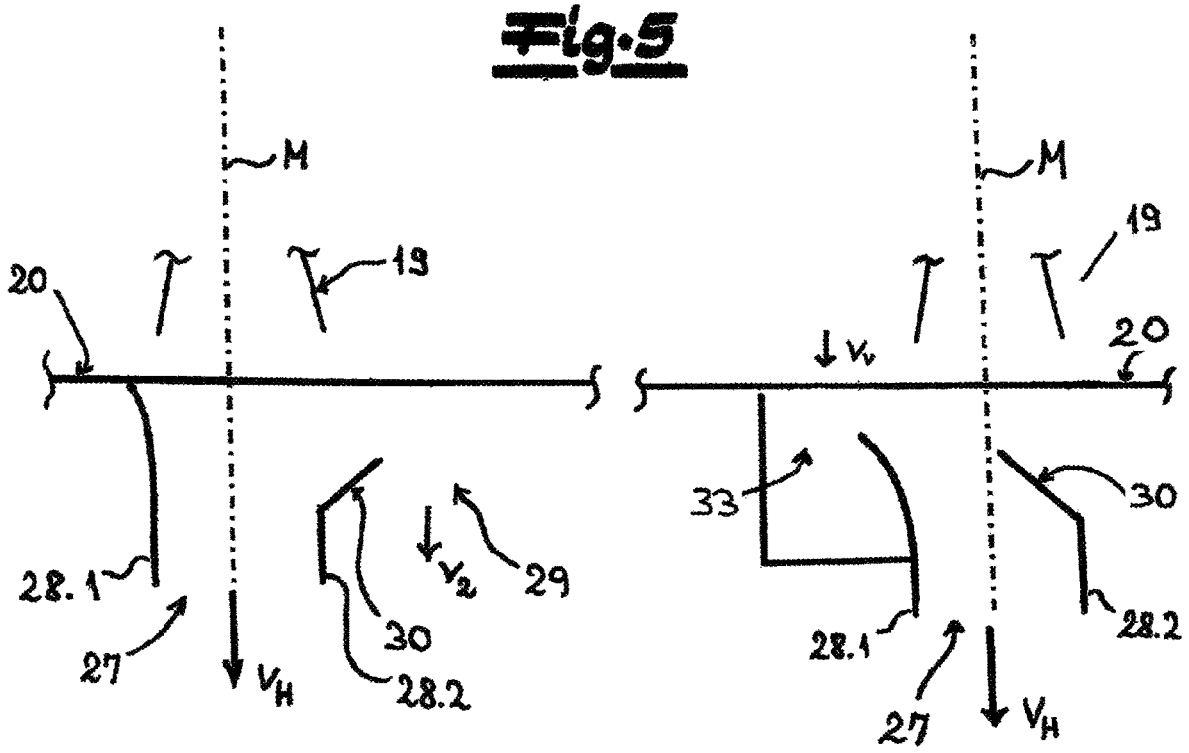
FIG. 5 is a vertical section through a two-beam system or multibeam system with two parts according to the invention for making a nonwoven fabric and FIG. 6 is a section through a filament preferably used for the nonwoven fabrics made according to the invention with an eccentric core-sheath configuration.

FIG. 5 shows a two-bar system with two spunbond apparatuses according to the invention connected in series that preferably and according to this embodiment deposit endless filaments 2 on the same mesh belt 20 for the nonwoven web. To this extent, this system produces a laminate of two nonwoven webs or two spunbond nonwoven fabrics 1. In principle, this system could also be part of a multibeam system with further spinnerets 10.

For the sake of simplicity, the complete spunbond apparatuses were not shown in FIG. 5, but only the lower part with the diffuser 19 above the mesh belt 20. It is within the scope of the invention that both spunbond apparatuses have a structure corresponding to the spunbond apparatus according to FIG. 1 above the mesh belt 20. In the first bar or in the first spinneret 10 on the left in FIG. 5, a first spoiler 30 is connected to the downstream suction partition 28.2 of the main extraction area 27, and preferably and according to this embodiment this spoiler 30 is angled to the side of the connected suction partition 28.2 facing away from the center of this left main extraction area 27. As a result, a smooth continuous transition of the extraction speeds from the extraction speed $v_H$ in the main extraction area to the extraction speed $v_2$ in the second extraction area 29 is achieved. The first deposited nonwoven web then preferably runs through two thermal hot-air preconsolidaters that are preferably designed as a hot-air knife 31 and as a hot-air oven 32 downstream of this hot-air knife 31. The preconsolidaters are not shown in FIG. 5.

Subsequently, a further nonwoven web is deposited on the second bar or on the second spinneret 10 on the right side. This second nonwoven web is deposited on the first nonwoven web. In this second bar, the orientation of the spoiler 30 differs from the first bar. Here, the second spoiler 30 is also connected to the downstream suction partition 28.2 of the main extraction area 27. However, in contrast to the first bar, this second spoiler 30 of the second bar is angled toward the center of the second main extraction area 27. Here, a further extraction area 33, in which process air is sucked through the mesh belt 20 at an extraction speed $v_V$, is connected upstream of the main extraction area 27. This extraction speed $v_V$ of the upstream extraction area 33 is lower or significantly lower than the extraction speed $v_H$ of the subsequent main extraction area 27. In order to ensure continuous transition of the extraction speed from the upstream extraction area 33 to the main extraction area 27 here, in this second bar the spoiler 30 is angled toward the center of the main extraction area 27 in the manner described. This also ensures a smooth continuous transition of the extraction speeds from the upstream extraction area 33 to the main extraction area 27.

Figure 6:
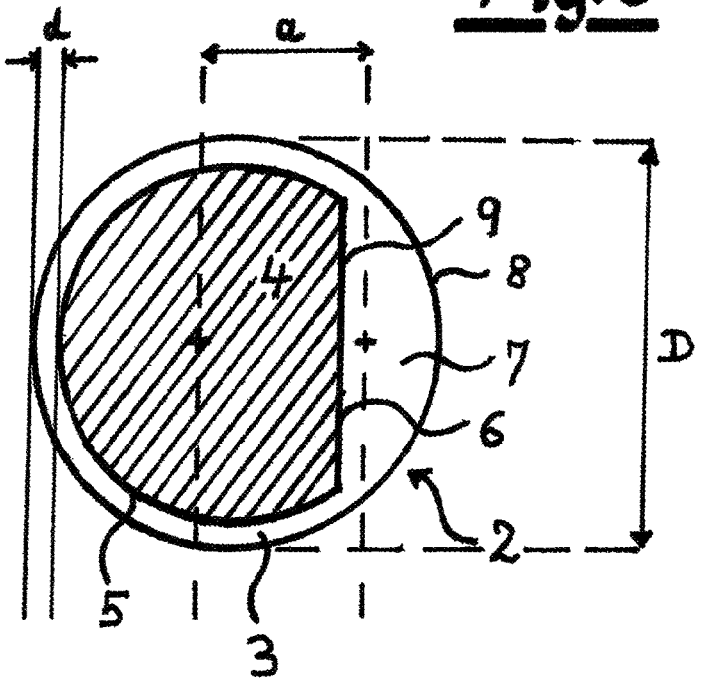

FIG. 6 shows a cross section through an endless filament 2 with a special core-sheath configuration. The manufacture of nonwoven fabrics 1 from these continuous filaments 2 has proven particularly useful in connection with the apparatus according to the invention and the method according to the invention. In the case of these continuous filaments 2, the sheath 3 has a constant thickness d in the filament cross section and, here, preferably over more than 50%, preferably over more than 55% of the filament circumference. Preferably and according to this embodiment, the core 4 of the filaments 2 occupies more than 65% of the area of the filament cross section of the filaments 2. As recommended and according to this embodiment, the core 4, seen in the filament cross section, is designed in the form of a segment of a circle. Expediently and here, this core 4 has a circularly arcuate surface region 5 and a straight surface region 6 with regard to its circumference. Preferably and according to this embodiment, the circular arcuate surface region of the core 4 takes up over 50%, preferably over 55% of the circumference of the core 4. Expediently and here, the sheath 3 of the filaments 2, seen in the filament cross section, is formed outside the sheath area with the constant thickness d in the form of a segment of a circle. This circular segment 7 of the casing 3 has, as recommended and according to this embodiment, a circular arcuate surface region 8 and a straight surface region 9 with regard to its circumference. The thickness d or the average thickness d of the sheath 3 in the region of its constant thickness is preferably 1% to 8%, in particular 2% to 10% of the filament diameter D. Here, the thickness d of the sheath 3 in the region of its constant thickness may be 0.2 μm to 3 μm.

FIG. 6 shows the spacing a of the centroid of the core 4 from the centroid of the surface of the sheath 3 of the endless filament 2. For a given mass ratio of core and sheath material, this spacing a of the centroid of the core 4 from the sheath 3 is generally greater in the case of the continuous filaments 2 preferred here than in the case of conventional continuous filaments 2 with an eccentric core-sheath configuration. The spacing a of the centroid of the core 4 from the centroid of the sheath 3 is preferably 5% to 40% of the filament diameter D or of the largest filament diameter D in the present filaments 2.

We claim:

1. An apparatus for making a nonwoven fabric from thermoplastic plastic filaments, the apparatus comprising:

a conveyor that is air permeable and has a horizontal face displaceable in a horizontal travel direction;

a spinneret above the conveyor for spinning the filaments and depositing the spun filaments on the face of the conveyor in a deposit area of the conveyor as a nonwoven web for conveyance in the travel direction; and an extractor beneath the conveyor that draws air or process air through the conveyor in the deposit area in a main extraction area below the conveyor and delimited by, relative to the travel direction, upstream and downstream suction partitions, one of the partitions having an upper end with an upper edge set at a predetermined vertical spacing below the conveyor equal to between 10 mm and 250 mm, the one suction partition having an upper end formed by a partition section that is angled from the rest of the one suction partition and forms a spoiler, the upper edge of the spoiler with the shortest vertical spacing from the conveyor having the predetermined vertical spacing from the conveyor, the spoiler being more angled relative to the vertical extending perpendicular to the face than an upper partition section of the other suction partition and/or in its projection onto the conveyor face having a greater length than the corresponding projection of an upper, angled or bent upper partition section of the other suction partition and/or having a greater spacing from the conveyor relative to its upper end than an upper edge of the upper partition section of the other suction partition.

2. The apparatus according to claim 1, wherein the one suction partition has at its upper end a spoiler in the form of an angular element with two spoiler parts arranged at an angle to one another, and an upper end edge of this spoiler has the predetermined vertical spacing from the conveyor.

3. The apparatus according to claim 2, wherein the spoiler has a spoiler part that is oriented transversely or substantially perpendicularly to the face of the conveyor, and the spoiler also has a spoiler part oriented parallel or substantially parallel to the face.

4. The apparatus according to claim 1, wherein only the downstream suction partition has the spoiler.

5. The apparatus according to claim 1, wherein the spoiler is aligned or angled to a side of the respective suction partition facing away from a center of the main extraction area or the spoiler is aligned or angled toward a center of the main extraction area.

6. The apparatus according to claim 1, wherein at least two of the spinnerets are provided spaced in the direction above the conveyor for spinning the filaments and therefore being upstream and downstream spinnerets, respective upstream and downstream main suction areas in which air or process air is sucked through the conveyor being associated with the respective upstream and downstream spinnerets, each of these main suction areas being delimited by two respective upstream and downstream suction partitions, at least one suction partition of each main suction area having a spoiler, the spoiler of the upstream suction area is aligned or angled to the side of the respective suction partition facing away from the center of the upstream suction area, and the spoiler of the downstream main extraction area is aligned or angled toward the center of the downstream main suction area.

7. The apparatus according to claim 1, further comprising:

a cooler downstream of the spinneret and above the conveyor;

a stretcher downstream of the cooler and above the conveyor; and a diffuser downstream of the stretcher and above the conveyor.

8. The apparatus according to claim 7, wherein the cooler and the stretcher form a subassembly closed to the admission of outside air other than cooling air in the cooler.

9. The apparatus according to claim 7, wherein the diffuser has relative to the direction upstream and downstream diffuser walls having respective lower diverging diffuser wall sections that are asymmetrical relative to a center plane of the diffuser or of the apparatus with the upstream diffuser wall section forming a smaller angle with the center plane of the diffuser or of the apparatus than the downstream diffuser wall section.

10. The apparatus according to claim 7, wherein the diffuser has relative to the direction upstream and downstream diffuser walls forming respective upstream and downstream secondary air inlet gaps at an upper end of the diffuser such that lower secondary air streams enter through the secondary air inlet gaps.

11. The apparatus according to claim 1, wherein the extractor has second upstream and downstream partition walls spaced in the direction from the main extraction area and forming a second extraction area where air or process air is drawn through the conveyor, when the second extraction area is downstream of the main extraction area, the extractor draws air through it at extraction speed $v_2$ lower than an extraction speed $V_H$ in the main extraction area, and/or when the second extraction area is upstream of the main extraction area, the extractor draws air through it at an extraction speed lower $V_v$ than the extraction speed in the main extraction area.

12. The apparatus according to claim 11, wherein the downstream partition wall of the main extraction area and the second downstream partition wall of the second extraction area are spaced differently from the face of the conveyor such that there is a continuous uniform transition between the extraction speed $v_H$ of the main extraction area and the extraction speed $v_2$ of the second extraction area.

13. The apparatus according to claim 11, further comprising:

a preconsolidater for preconsolidating the nonwoven fabric on or above the second extraction area.

14. The apparatus according to claim 13, wherein a spacing in the direction between a center plane of the diffuser and the preconsolidater is 100 mm to 1000 mm.

15. A method of making a nonwoven fabric, the method comprising the steps of:

displacing an air-permeable conveyor belt in a horizontal travel direction;

delimiting a main extraction area below the conveyor belt by, relative to the direction, a downstream suction partition and by an upstream suction partition;

spinning filaments and depositing the spun filaments on an air-permeable conveyor belt at the main extraction area to form a nonwoven web;

delimiting below the conveyor belt a second extraction area spaced upstream or downstream from the main extraction area;

drawing air through the belt at the main extraction area at a greater extraction speed in the main extraction area than in the second extraction area, the extraction speed in the main extraction area being 1.5 to 4 times greater than the extraction speed in the second extraction area; and when the second extraction area is upstream of the main extraction area, spacing an upper end of the upstream suction partition below the belt or, when the second extraction area is downstream of the main section area, spacing an upper end of the downstream suction partition below the belt such that the extraction speed of the air flow through the belt decreases uniformly between the main extraction area and the second extraction area.

16. The method according to claim 15, wherein the filaments are continuous multicomponent filaments.

17. The method according to claim 15, wherein a change in the extraction speed between the speed in the main extraction area and the speed in the second extraction area has a gradient of 1 to 8 m/s.

18. The method according to claim 17, wherein the extraction speed changes uniformly and continuously from the extraction speed in the main extraction area to the extraction speed in the second extraction area in a transition zone of a length in the direction of at least 10 cm.

* * * * *